US007089829B2

(12) United States Patent
Chen

(10) Patent No.: US 7,089,829 B2
(45) Date of Patent: Aug. 15, 2006

(54) MULTI-FUNCTIONAL RATCHET WRENCH

(76) Inventor: Kun-Chen Chen, No. 6, Lane 609, Sec. 1, Chung-Shan Rd., Ye-Her Li, Tachia Chen, Taichung Hsien (TW)

( * ) Notice: Subject to any disclaimer, the term of this patent is extended or adjusted under 35 U.S.C. 154(b) by 209 days.

(21) Appl. No.: 10/890,196

(22) Filed: Jul. 14, 2004

(65) Prior Publication Data

US 2006/0011019 A1 Jan. 19, 2006

(51) Int. Cl.
*B25B 13/46* (2006.01)

(52) U.S. Cl. ..... 81/63.1; 81/63.2; 81/62

(58) Field of Classification Search ..... 81/63.1, 81/63.2, 63, 62, 59.1, 60, 58
See application file for complete search history.

(56) References Cited

U.S. PATENT DOCUMENTS 3,572,188 A * 3/1971 Christian, Jr. ..... 81/57.46
4,781,083 A * 11/1988 Cummings ..... 81/63.1
5,125,297 A * 6/1992 Bai et al. ..... 81/57.31
5,211,087 A * 5/1993 Thomason ..... 81/63.2
6,053,077 A * 4/2000 Huang ..... 81/63.1
6,295,895 B1 * 10/2001 Hejninger ..... 81/57.39
6,431,031 B1 * 8/2002 Hu ..... 81/63.2
2006/0011019 A1 * 1/2006 Chen ..... 81/63.1

* cited by examiner

*Primary Examiner*—Lee D. Wilson
(74) *Attorney, Agent, or Firm*—Rosenberg, Klein & Lee

(57) ABSTRACT

A multi-functional ratchet wrench has a wrench body, a ratchet, a pawl, a trigger, a lug connector and a socket connector. The wrench body has a head in which the ratchet is rotatably mounted and the pawl control the direction of rotation when moved by the trigger connected to the pawl. The lug connector is formed on one side of the ratchet, and the socket connector formed on the opposite side of the ratchet. The socket connector comprises a connecting tube, an outer collar and a latching device. The connecting tube selectively holds a tool bit. The outer collar is mounted slidably on the connecting tube. The latching device is clamped between the connecting tube and the outer collar to cause the outer collar to stay in position to hold the tool bit in the connecting tube. Thereby, the ratchet wrench can selectively use different tool bits.

6 Claims, 8 Drawing Sheets

MULTI-FUNCTIONAL RATCHET WRENCH

BACKGROUND OF THE INVENTION

1. Field of the Invention

The present invention relates to a ratchet wrench, more particularly to a ratchet wrench that has two connecting devices.

2. Description of Related Art

With reference to FIG. 8, a conventional ratchet wrench comprises a body (60), a ratchet (70), a pawl (80), a trigger (90) and a cover (92).

The wrench body (60) has a cavity (62), a head (601) and a handle (602). The cavity (62) is defined in the head (601) and has a main recess (not numbered) and a sub-recess (not numbered). The head (601) has a rear face (not numbered) and an optional ball-spring combination (64). The sub-recess has an inner wall (not numbered). The ball-spring combination (64) is mounted in the inner wall in the sub-recess and extends partially into the cavity (62).

The ratchet (70) is rotatably mounted in the main recess in the cavity (62) and has a toothed outer edge (72), a front face (not numbered) and a polygonal lug (74). The polygonal lug (74) extends from the front face of the ratchet (70) and protrudes out of the cavity (62).

The pawl (80) is mounted in the sub-recess in the cavity (62) has two toothed faces (not numbered) and optional detents (not numbered). The toothed faces selectively engage the ratchet (70) and allow the ratchet (70) to rotate in only one direction. One of the detents engages the ball-spring combination (64) in the sub-recess to hold the pawl (80) in position.

The trigger (90) is connected to the pawl (80) outside the rear face of the head (601) to switch the wrench between clockwise and counterclockwise rotations.

However, the ratchet wrench only has a single tool lug, i.e. the polygonal lug (74), to drive one particular tool having a corresponding polygonal hole so the ratchet wrench cannot be used in many cases.

The present invention has arisen to mitigate or obviate the drawbacks of the conventional ratchet wrench.

SUMMARY OF THE INVENTION

The main objective of the present invention is to provide a multi-functional ratchet wrench that has two connectors to increase the versatility and use of the ratchet wrench.

A multi-functional ratchet wrench has a wrench body, a ratchet, a pawl, a trigger, a lug connector and a socket connector. The wrench body has a head in which the ratchet is rotatably mounted and the pawl control the direction of rotation when moved by the trigger connected to the pawl. The lug connector is formed on one side of the ratchet, and the socket connector formed on the opposite side of the ratchet. The socket connector comprises a connecting tube, an outer collar and a latching device. The connecting tube selectively holds a tool bit. The outer collar is mounted slidably on the connecting tube. The latching device is clamped between the connecting tube and the outer collar to cause the outer collar to stay in position to hold a tool bit in the connecting tube. Thereby, the ratchet wrench can selectively use different tool bits.

Further benefits and advantages of the present invention will become apparent after a careful reading of the detailed description with appropriate reference to the accompanying drawings.

DETAILED DESCRIPTION OF THE PREFERRED EMBODIMENT

A multi-functional ratchet wrench in accordance with the present invention comprises a wrench body, a ratchet, a pawl, a trigger, a lug connector and a socket connector. The wrench body has a head and a handle. The head has a front, a rear and a cavity.

The ratchet and the pawl are mounted in the cavity. The ratchet has a front and a rear side. The trigger is connected to the pawl to select which segment of the pawl is engaged with the ratchet. Since the structure and operation of the ratchet and pawl are essentially conventional, further discussion regarding the interaction between the ratchet and the pawl has been excluded from further discussion.

The lug connector is formed on one side of the ratchet and protrudes from the corresponding side of the head, and the socket connector is formed on the other side of the ratchet opposite to the lug connector and protrudes from the corresponding side of the head.

The socket connector comprises a connecting tube, an outer collar and a latching device and adapts to hold a tool shaft. The outer collar is mounted slidably on the connecting tube, and the latching device is mounted between the connecting tube and the outer collar to selectively engage and hold the tool shaft in the connecting tube. Thereby, fundamentally different tool bits can be mounted selectively on the two connectors of the ratchet wrench.

Figure 1:
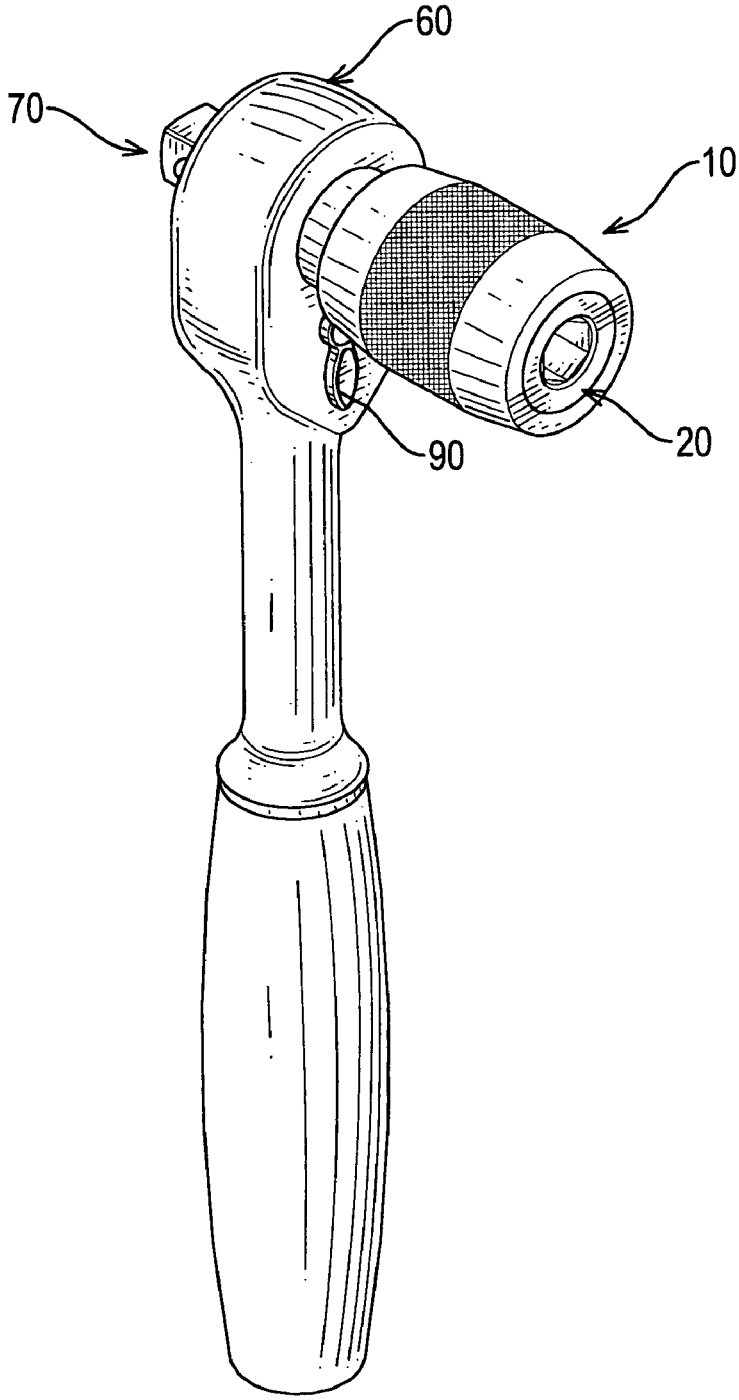
FIG. 1 is a perspective view of a multi-functional ratchet wrench in accordance with the present invention.
Figure 2:
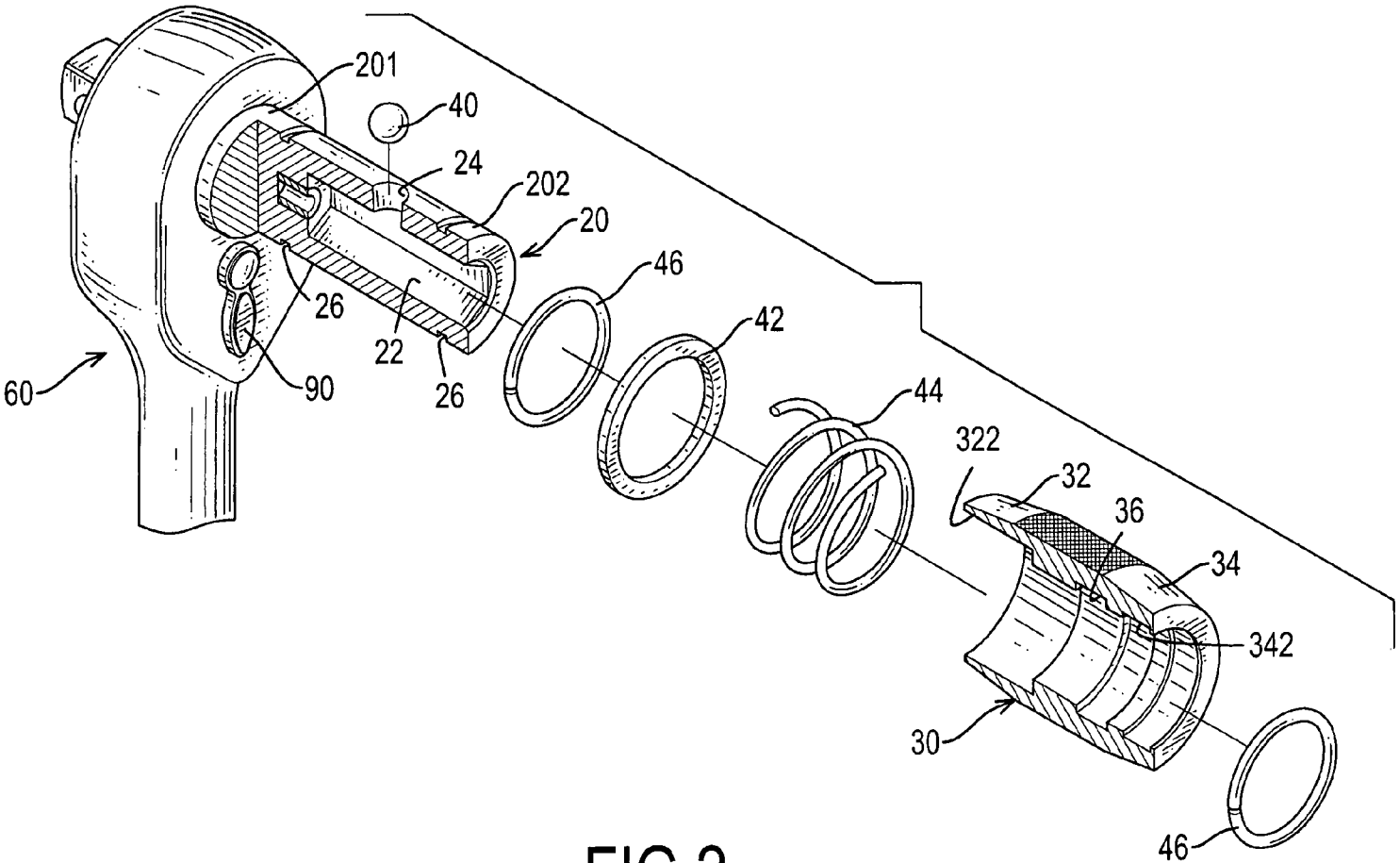
FIG. 2 is an enlarged exploded perspective view in partial section of a socket connector on the multi-functional ratchet wrench in FIG. 1.
Figure 8:
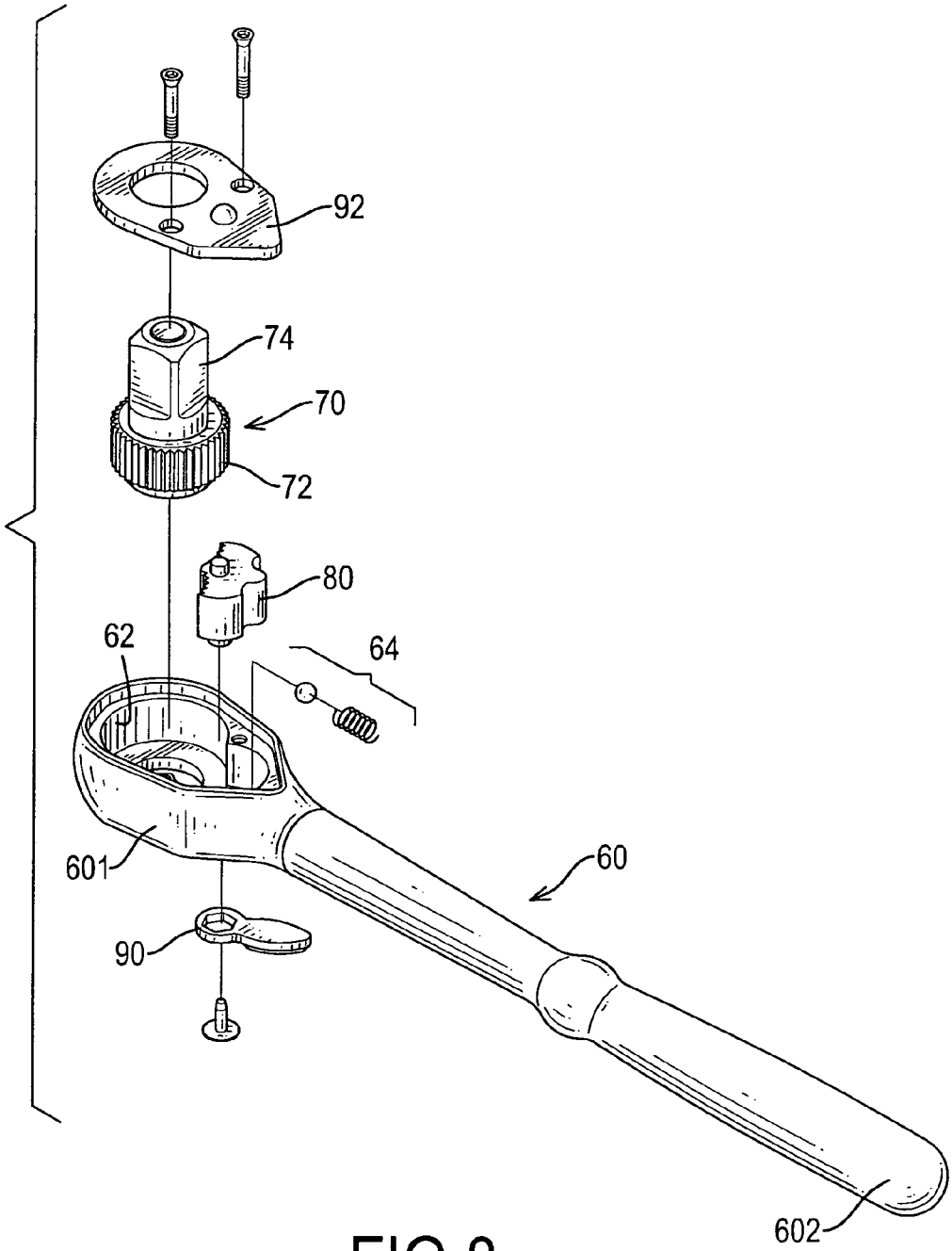
FIG.8 PRIOR ART
FIG. 8 is an exploded perspective view of a conventional ratchet wrench in accordance with the prior art.

With reference to FIGS. 1 and 2, a preferred embodiment of the multi-functional ratchet wrench in accordance with the present invention comprises a wrench body (60) a ratchet (70), a pawl, a trigger (90), a lug connector and a socket connector (10). Wherein, the wrench body (60), the ratchet (70), the pawl, the trigger, and the lug connector is preferred to have the same configuration with the one described in the prior art as shown in FIG. 8. The wrench body (60) has a head and a handle. The head (60) has a front, a rear and a cavity. The ratchet (70) and the pawl are mounted in the cavity and selectively engage each other. The ratchet (70) has a front side and a rear side. The trigger (90) is attached to the pawl to selectively attach the pawl to the ratchet (70). The lug connector is formed on one side of the ratchet (70) and protrudes from the corresponding side of the head and the socket connector (10) is formed on the opposite side of the ratchet (70) from the lug connector and protrudes from the corresponding side of the head.

The socket connector (10) is formed on the ratchet (70) opposite to the lug connector (74) and rotates with the ratchet (70). The socket connector (10) comprises a connecting tube (20), an outer collar (30), and a latching device.

Figure 3:
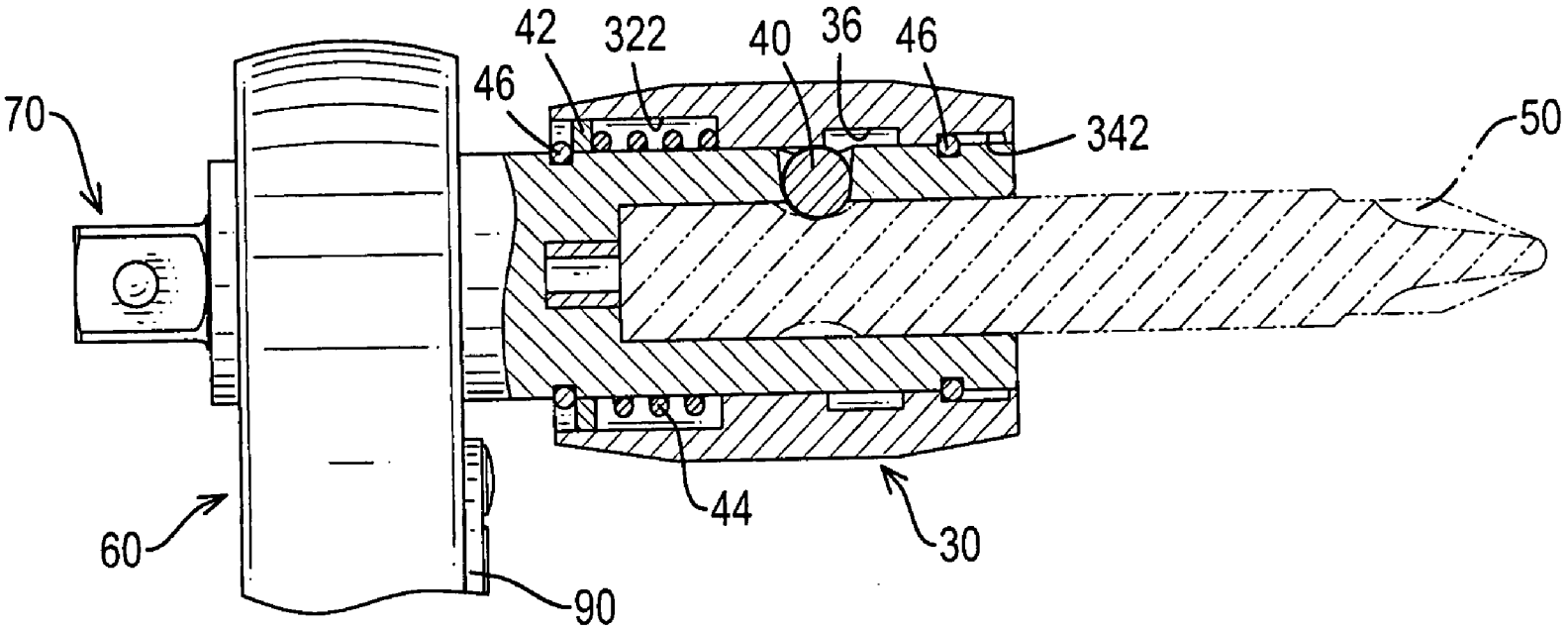
FIG. 3 is a cross-sectional side view of the socket connector in FIG. 2.

The connecting tube (20) is cylindrical and has a proximal end (201), a distal end (202), an outer surface, an inner channel (22), a ball recess (24), and two optional annular grooves (26). The proximal end (201) is formed on the ratchet (70) so the connecting tube (20) rotates with the ratchet (70). The inner channel (22) is defined coaxially inside the connecting tube (20) and extends to the distal end (202) to receive a tool shaft (50) as shown in FIG. 3. The ball recess (24) is a tapered hole, is defined radially through the connecting tube (20) between the abutting end (201) and the distal end (202) and communicates with the inner channel (22). The two optional annular grooves (26) are defined around the outer surface of the connecting tube (20) respectively near the proximal end (201) and the distal end (202).

With further reference to FIG. 3, the outer collar (30) is tubular, is mounted slidably around the connecting tube (20) and has an inner end (32), an outer end (34), an outer surface, an inner surface, a spring recess (322), a ball dent (36) and an optional ring recess (342). The spring recess (322) is defined in the inner surface at the inner end (32), and the ring recess (342) is annular and is defined in the inner surface near the outer end (34). The ball dent (36) is annular and is defined in the inner surface between the spring recess (322) and the ring recess (342). The outer surface of the outer collar (30) further preferably has a knurled area defined around the outer collar (30).

The latching device between the outer collar (30) and the connecting tube (20) in the present invention comprises a ball (40), a washer (42), a spring (44) and two optional resilient rings (46). The ball (40), washer (42), spring (44) and two resilient rings (46) are all clamped between the connecting tube (20) and the outer collar (30). The ball (40) is mounted inside the ball recess (24) and protrudes into the inner channel (22) to operationally engage a neck in the tool shaft (50). The spring (44) is mounted inside the spring recess (322) around the connecting tube (20). The washer (42) is mounted around the outer surface of the connecting tube (20) to hold the spring (44) inside the tapered spring recess (322). One optional resilient ring (46) is mounted inside the annular groove (26) near the proximal end (201) to hold the washer (42). The other optional resilient ring (46) is mounted in the other annular groove (26) near the distal end (202) to keep the outer collar (30) from sliding off the connecting tube (20).

Figure 4:
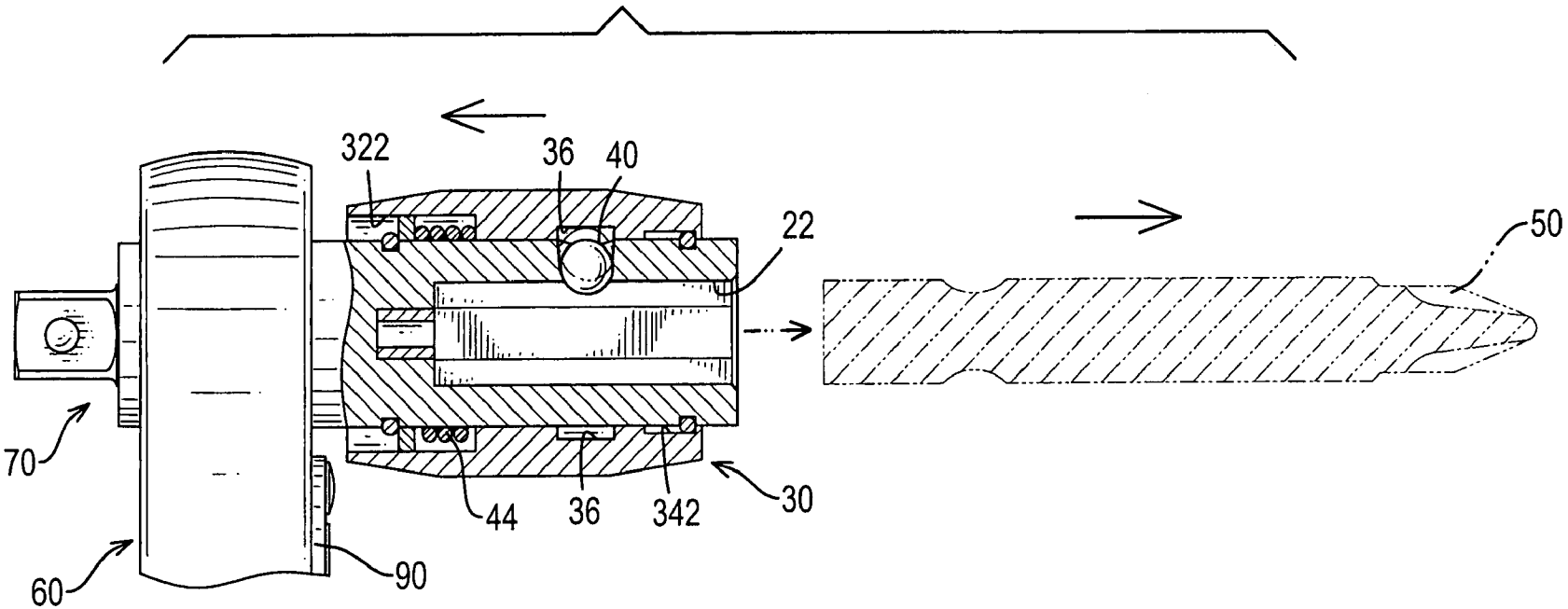
FIG. 4 is an operational cross-sectional side view of the socket connector in FIG. 3.

With reference to FIG. 4, the socket connector (10) is operated by pushing the outer collar (30) toward the wrench body (60) to align the ball dent (36) with the tapered ball recess (24) so the ball (40) will release the neck of the tool shaft (50).

Figure 5:
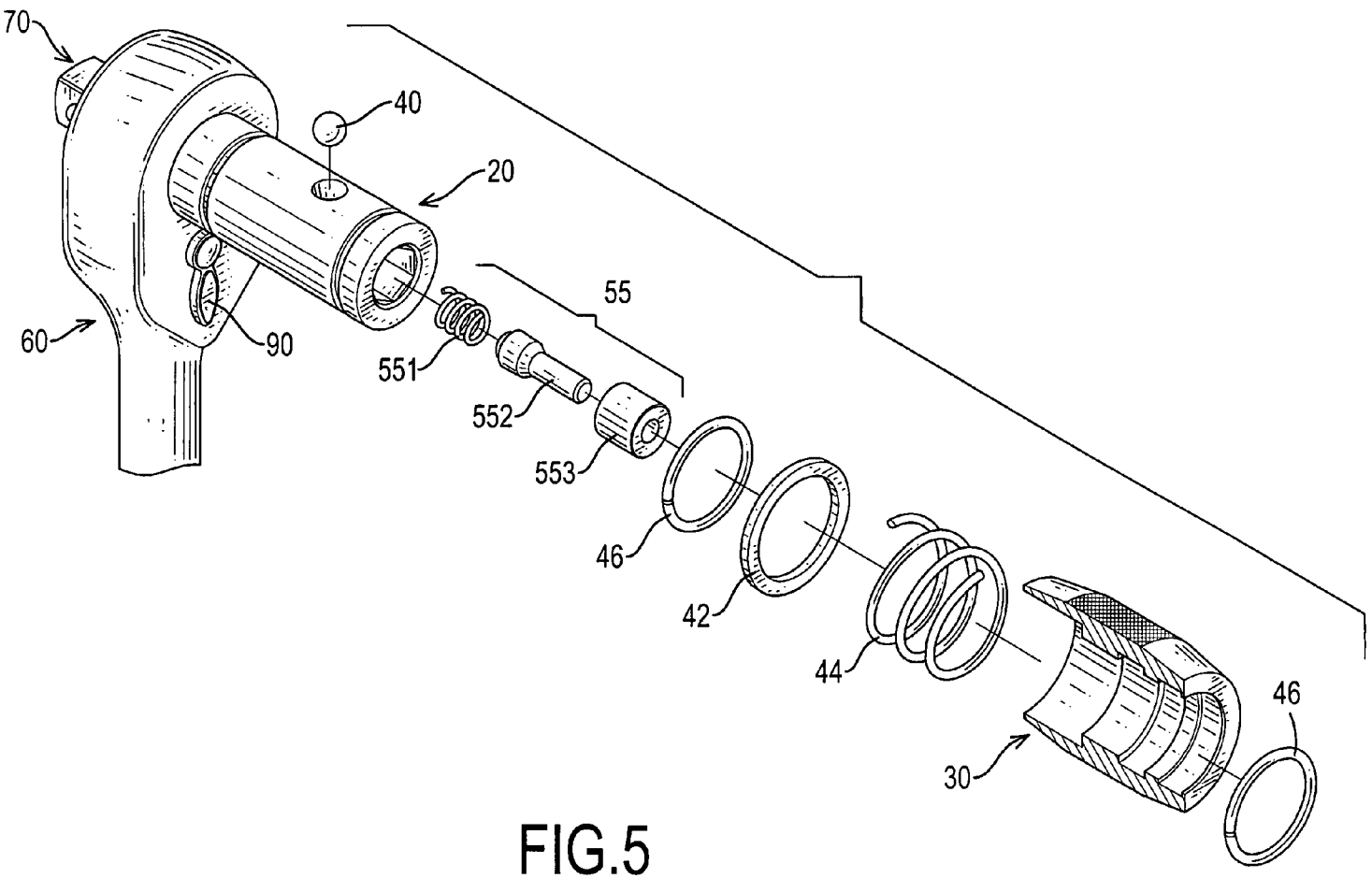
FIG. 5 is an enlarged exploded perspective view of another embodiment of a socket connector on the multi-functional ratchet wrench in accordance with the present invention.
Figure 6:
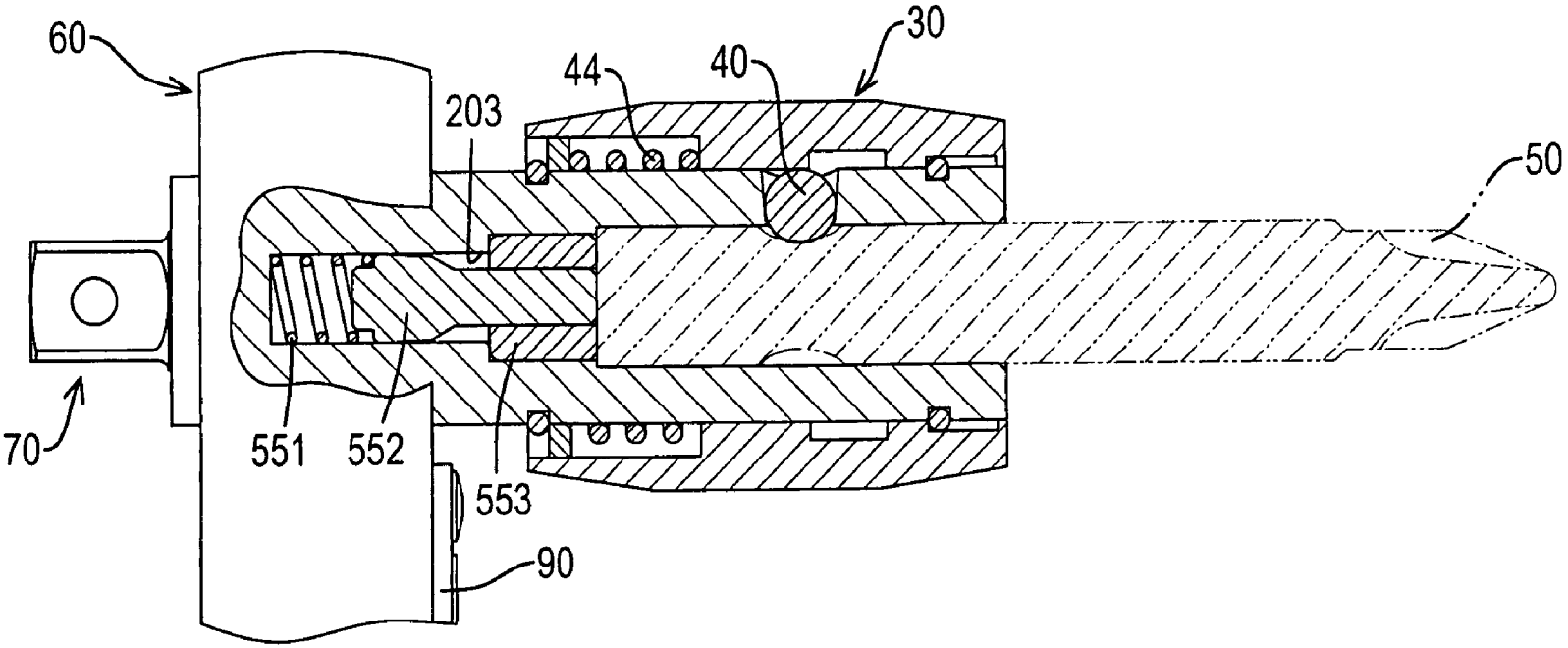
FIG. 6 is a cross-sectional side view of the socket connector in FIG. 5 in assembly.
Figure 7:
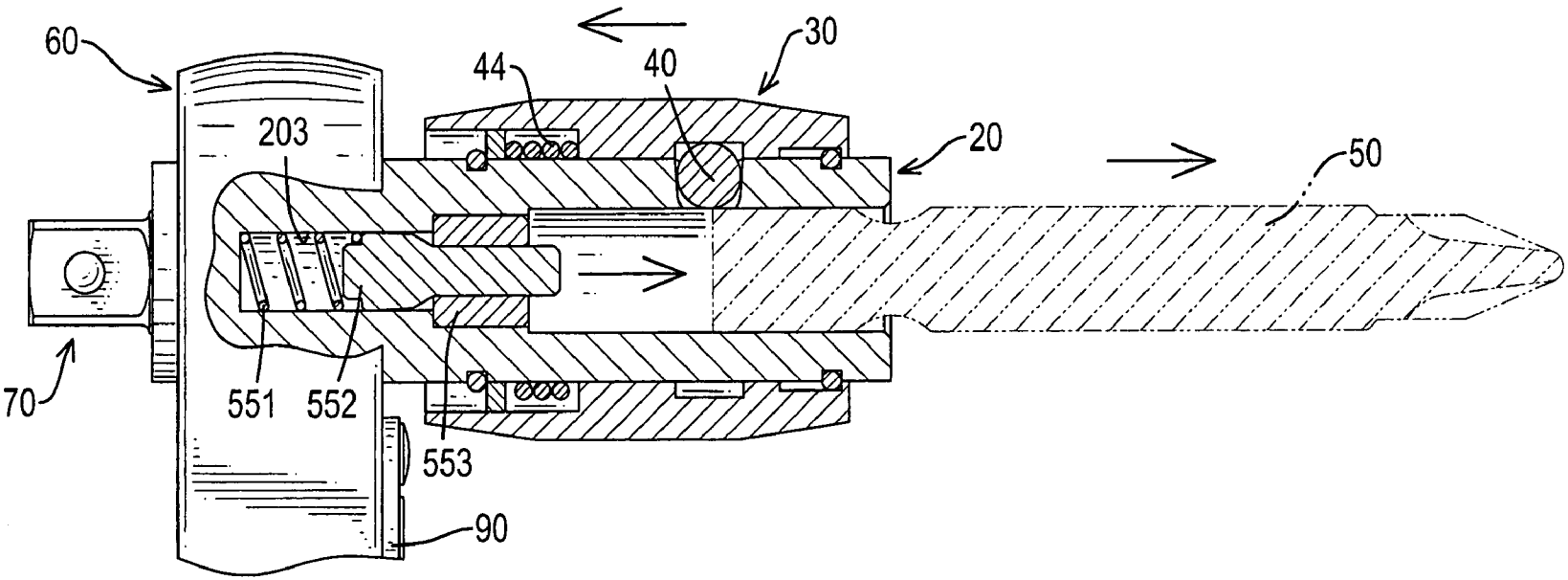
FIG. 7 is an operational cross-sectional side view of the socket connector in FIG. 5.

With reference to FIGS. 5 to 7, another preferred embodiment of a socket connector for the multi-functional ratchet wrench in accordance with the present invention has the same structure as the previously described socket connector except for an ejecting device (55). The ejecting device (55) is mounted inside the proximal end (201) of the connecting tube (20) and comprises an ejecting spring (551), a piston (552) and a holding ring (553). The connecting tube (20) further has an inner cavity (203) formed coaxially with the inner channel (22). The inner cavity (203) has a bottom and forms a shoulder in the inner channel (22). The ejecting spring (551) is mounted in the bottom of the inner cavity (203), and the piston (552) has a narrow coaxial shaft and is mounted on the ejecting spring (551). The holding ring (553) is mounted on the shoulder of the inner channel (22) around the narrow shaft of the piston (522) to keep the piston aligned coaxially with the inner channel (22). The ejecting spring (551) applies pressure on the piston (552) to eject a tool shaft (50) when the outer collar (30) is pushed toward the wrench body (60) to release the latching device. Therefore, the socket connector is quite convenient to use.

The multi-functional ratchet wrench in accordance with the present invention has the following advantages:

1. The multi-functional ratchet wrench has two different connectors that allow the ratchet wrench to be used with different types of tool bits.

2. The socket connector on the multi-functional ratchet wrench further has an ejecting device that makes the detachment of tool bits convenient.

Although the invention has been explained in relation to multiple preferred embodiments, many other possible modifications and variations can be made without departing from the spirit and scope of the invention as hereinafter claimed.

What is claimed is:

1. A multi-functional ratchet wrench comprising:

a wrench body (60) having a head (601) with a front, a rear and a cavity (62); and a handle (602) extending from the head (601);

a ratchet (70) rotatably mounted in the cavity (62) and having a front side, a rear side and a toothed outer edge;

a pawl (80) mounted in the cavity (62) and selectively engaging the toothed outer edge of the ratchet (70);

a lug connector formed on one side of the ratchet (70) and protruding from the head (601);

a trigger (90) connecting to the pawl (80) to selectively engage the pawl (80) with the ratchet (70) to determine rotating in two directions; and a socket connector (10) formed on the other side of the ratchet (70) and comprising:

a connecting tube (20) being cylindrical and having a proximal end (201) formed on the ratchet (70), a distal end (202), an outer surface, an inner channel (22) defined coaxially inside the connecting tube (20) and extending to the distal end (202) and a tapered ball recess (24) defined radially through the connecting tube (20) between the abutting end (201) and the distal end (202) and communicating with the inner channel (22);

an outer collar (30) being tubular, mounted slidably around the connecting tube (20) and having an inner end (32), an outer end (34), an outer surface, an inner surface, a spring recess (322) defined in the inner surface near the inner end (32) and a ball dent (36) being annular and defined in the inner surface; and a latching device clamped between the outer collar (30) and the connecting tube (20) and comprising a ball (40) mounted inside the tapered ball recess (24) and partially protruding into the inner channel (22);

a spring (44) mounted inside the spring recess (322) s around the connecting tube (20) to provide a restitution force to the outer collar (30); and a washer (42) mounted around the outer surface of the connecting tube (20) to hold the spring (44) inside the tapered spring recess (322).

2. The multi-functional ratchet wrench as claimed in claim 1, wherein the connecting tube (20) further has two optional annular grooves (26) defined in the outer surface of the connecting tube (20) respectively near the proximal end (201) and the distal end (202);

the latching device further has two resilient rings (46), one resilient ring (46) is mounted in the annular groove (26) near the proximal end (201) to hold the washer (42) in position, and the other optional resilient ring (46) is mounted in the other annular groove (26) near the distal end (202) to keep the outer collar (30) from sliding off the connecting tube (20); and the outer collar (30) further has a ring recess (342) defined in the inner surface near the outer end (34).

3. The multi-functional ratchet wrench as claimed in claim 2, wherein the connecting tube (20) further has an inner cavity (203) formed coaxially with the inner channel (22), having a bottom and forming a shoulder in the inner channel (22); and the ratchet wrench further has an ejecting device (55) mounted inside the inner cavity (203) and comprising:

an ejecting spring (551) mounted in the bottom of the inner cavity (203);

a piston (552) having a narrow coaxial shaft and mounted on the ejecting spring (551); and a holding ring (553) mounted on the shoulder of the inner channel (22) and around the narrow shaft of the piston (522) to keep the piston aligned coaxially with the inner channel (22).

4. The multi-functional ratchet wrench as claimed in claim 1, wherein the outer collar (30) further has a knurled area defined on the outer surface.

5. The multi-functional ratchet wrench as claimed in claim 4, wherein the connecting tube (20) further has an inner cavity (203) formed coaxially with the inner channel (22), having a bottom and forming a shoulder in the inner channel (22); and the ratchet wrench further has an ejecting device (55) mounted inside the inner cavity (203) and comprising:

an ejecting spring (551) mounted in the bottom of the inner cavity (203);

a piston (552) having a narrow coaxial shaft and mounted on the ejecting spring (551); and a holding ring (553) mounted on the shoulder of the inner channel (22) and around the narrow shaft of the piston (522) to keep the piston aligned coaxially with the inner channel (22).

6. The multi-functional ratchet wrench as claimed in claim 1, wherein the connecting tube (20) further has an inner cavity (203) formed coaxially with the inner channel (22), having a bottom and forming a shoulder in the inner channel (22); and the ratchet wrench further has an ejecting device (55) mounted inside the inner cavity (203) and comprising:

an ejecting spring (551) mounted in the bottom of the inner cavity (203);

a piston (552) having a narrow coaxial shaft and mounted on the ejecting spring (551); and a holding ring (553) mounted on the shoulder of the inner channel (22) and around the narrow shaft of the piston (522) to keep the piston aligned coaxially with the inner channel (22).

* * * * *